US011896130B2

(12) United States Patent
Speters

(10) Patent No.: US 11,896,130 B2
(45) Date of Patent: Feb. 13, 2024

(54) MATTRESS FOOT COVER

(71) Applicant: Purple Innovation, LLC, Lehi, UT (US)

(72) Inventor: Cindy Speters, Draper, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 17/497,683

(22) Filed: Oct. 8, 2021

(65) Prior Publication Data

US 2022/0110454 A1 Apr. 14, 2022

Related U.S. Application Data

(60) Provisional application No. 63/089,282, filed on Oct. 8, 2020.

(51) Int. Cl.
*A47C 21/02* (2006.01)

(52) U.S. Cl.
CPC ..... *A47C 21/022* (2013.01)

(58) Field of Classification Search
CPC ..... A47C 21/00; A47C 21/02; A47C 21/022; A47C 21/028; A47C 21/06; A47C 21/08
See application file for complete search history.

(56) References Cited

U.S. PATENT DOCUMENTS 2,543,552 A * 2/1951 Leader ..... A47C 21/06 5/499
3,090,052 A * 5/1963 Goldsmith ..... A47C 21/022 5/482
3,803,645 A * 4/1974 Oliverius ..... A47C 21/06 5/505.1
4,045,832 A * 9/1977 DiForti ..... A47G 9/0246 5/496
4,144,602 A * 3/1979 Fernandes ..... A47C 21/022 5/923
4,625,352 A * 12/1986 Kobayashi ..... A47C 21/022 24/72.5
4,884,305 A * 12/1989 Blackmon ..... A47C 21/022 24/72.5
5,084,929 A * 2/1992 Staudinger ..... A47D 15/008 5/494
2004/0003469 A1* 1/2004 Gill-Barajas ..... A47C 21/08 5/636
2004/0139547 A1* 7/2004 Wootten, Jr. ..... A47C 21/022 5/497
2008/0016619 A1* 1/2008 Chuang ..... A47G 9/0261 5/501
2008/0216238 A1* 9/2008 Tatsuno ..... A47G 9/086 5/420
2010/0269259 A1* 10/2010 Campbell ..... A47C 21/022 5/498

(Continued)

*Primary Examiner* — Justin C Mikowski
*Assistant Examiner* — George Sun
(74) *Attorney, Agent, or Firm* — DENTONS Durham Jones Pinegar

(57) ABSTRACT

A mattress foot cover includes a top panel, a foot panel, side panels, and a bottom panel that define an opening and a void that receive the foot portion of a mattress, enabling the cover to fit snugly over the foot portion of the mattress. The cover may prevent the mattress or bed linens on the mattress from getting dirty in a mattress or furniture showroom. The cover is adjustable and removable to appropriately fit an applicable mattress.

17 Claims, 4 Drawing Sheets

(56) References Cited

U.S. PATENT DOCUMENTS

| | | | | |
|---|---|---|---|---|
| 2010/0281615 | A1* | 11/2010 | Truex | A47C 19/022 5/488 |
| 2011/0231994 | A1* | 9/2011 | Avila-Robinson | A47C 21/00 5/503.1 |
| 2013/0152306 | A1* | 6/2013 | Monaco | A47C 21/022 5/498 |
| 2014/0208508 | A1* | 7/2014 | Mikesell | A47G 9/02 5/497 |
| 2015/0033475 | A1* | 2/2015 | Khan | A47G 9/0223 5/498 |
| 2015/0305524 | A1* | 10/2015 | Shilts | G08B 21/18 5/636 |
| 2016/0143448 | A1* | 5/2016 | Jackson | A47C 21/00 5/503.1 |
| 2018/0303256 | A1* | 10/2018 | Sturgeon | A47C 21/028 |
| 2019/0099018 | A1* | 4/2019 | Holt | A47G 9/0238 |
| 2019/0159611 | A1* | 5/2019 | Siebuhr | A47G 9/0238 |
| 2020/0085200 | A1* | 3/2020 | Engemann | A47C 21/022 |
| 2020/0128967 | A1* | 4/2020 | Cote | A47G 9/0238 |

* cited by examiner

MATTRESS FOOT COVER

CROSS-REFERENCE TO RELATED APPLICATION

A claim for priority to the Oct. 8, 2020 filing date of U.S. Provisional Patent Application No. 63/089,282 ("the '282 Provisional Application"), titled MATTRESS FOOT COVERS, is hereby made pursuant to 35 U.S.C. § 119(e). The entire disclosure of the '282 Provisional Application is hereby incorporated herein.

TECHNICAL FIELD

This disclosure relates generally to foot covers or covers that are positioned at the end of a bed in a showroom. Specifically, the covers are intended to keep beds and bed linens cleans as individuals are testing different mattresses and beds. More specifically, this disclosure relates to covers which are capable of fitting different sizes of mattresses and securing firmly to itself, which may be through a frictional, snug fit on the mattress and may be positioned toward the foot of the mattress.

RELATED ART

People who shop for mattresses often visit showrooms where a variety of mattresses are displayed. As part of the process of shopping for a mattress in a mattress showroom, people will try out several of the options that are available in the showroom. Trying out a mattress typically includes sitting on the mattress, bouncing up and down on the mattress, and lying on the mattress.

Typically, visitors to a mattress showroom have worn shoes or other footwear into the showroom. Since they are walking around the showroom, they typically leave their shoes or other footwear on their feet. As the visitors lie on the mattresses, they typically keep their footwear on their feet. Dirt and other substances on the footwear may soil the mattresses, diminishing their appearance and, thus, their appeal to potential purchasers.

SUMMARY

Various embodiments of a cover for the foot of a mattress, or a mattress foot cover or simply a cover, are disclosed. A cover for the foot of a mattress according to this disclosure may include a top panel, a base panel, and three side panels. The top panel and the base panel may be connected around a periphery to each of the three side panels. The panels may define a void and an opening that receive a foot portion of a mattress, with the three side panels extending along the vertically oriented foot and sides of a mattress.

A configuration of the cover may enable it to be positioned on or toward a foot of a mattress and to extend a specified distance toward the head of the mattress (e.g., less than halfway up the mattress, etc.).

The cover may be adjustable to enable it to be snugly fitted to and secured in place over the foot of the mattress. The adjustability of the cover may be provided by any of the panels, but may be primarily provided on the bottom panel to hide fasteners and features that enable adjustment of the cover. The base panel of the cover may include portions that may be pulled together and coupled to each other in a manner that allows for extension or retraction of the side panels of the cover to fit mattresses of different widths and/or thicknesses/heights.

The top panel may include a pocket positioned on or within the top panel. The pocket may be configured to allow for reading material to be placed within such pocket. The pocket may be partially securely closed with a fastener, which may be hook and loop fasteners. The pocket may have a two-sided opening or single sided opening with a fastener on at least one of those sides.

Methods for securing a cover to a foot portion of a mattress are also disclosed.

Features and advantages of various aspects of the disclosed subject matter and other aspects of the disclosed subject matter should become apparent to those of ordinary skill in the art through consideration of the ensuing description, the accompanying drawings, and the appended claims.

DETAILED DESCRIPTION

Figure 1:
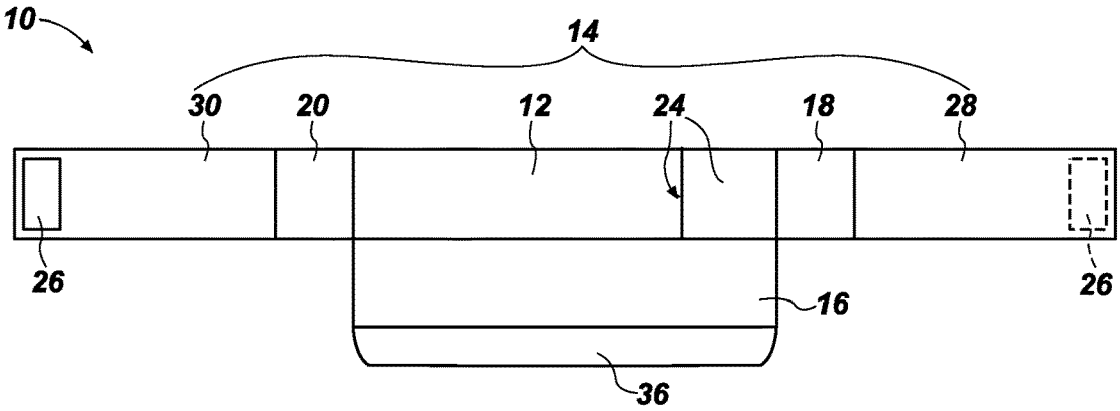
FIG. 1 is a top plan view of an embodiment of a mattress foot cover, showing the mattress foot cover in a disassembled arrangement.

Referring to FIG. 1, an embodiment of a mattress foot cover 10, which may also be referred to herein as a "cover" for the sake of simplicity, is depicted in a disassembled relationship. The cover 10 includes a top panel 12, a bottom panel 14, a foot panel 16, a right panel 18, and a left panel 20. A left side edge of the top panel 12 is secured a top edge of the left panel 20. A foot edge of the top panel 12 is secured to a top edge of the foot panel 16. A right side edge of the top panel 12 is secured to a top edge of the right panel 18. Although not shown in FIG. 1 (see, e.g., FIGS. 6-10), foot edges of the right panel 18 and left panel 20 are secured to right and left edges, respectively, of the foot panel 16.

The top panel 12, bottom panel 14, and foot panel 16 may be substantially rectangular in shape. Each of the top panel 12, bottom panel 14, and foot panel 16 may have a width (from the left side to right side of each panel in the orientations shown in FIG. 1) that exceeds its length (top panel 12 and bottom panel 14) or height (foot panel 16) (from the top to the bottom of each panel in the orientations shown in FIG. 1). When assembled with a mattress 2, as shown in FIGS. 6-10, the widths of the top panel 12, bottom panel 14, and foot panel 16 may extend along the foot of the mattress 2 (i.e., the width of the mattress). The lengths of the top panel 12 and bottom panel 14 may extend from the foot of the mattress 2 toward the head of the mattress 2. The height of the foot panel 16 extends along the height of the foot of the mattress 2. The widths of the top panel 12 and foot panel 16 may be the same.

The right panel 18 and left panel 20 may also be rectangular in shape. The lengths of the right panel 18 and left panel 20, which extend from foot of the mattress 2 toward the head of the mattress 2, may be the same as the length of the top panel 12.

In some embodiments, the top panel may include a pocket 24. The pocket 24 may include a single opening or it may be a flap of rectangular (or other polygonal shape) material on top of the top panel 12 that is secured along two sides of the periphery of the pocket 24 to the top panel 12 and open on the remaining two sides of the pocket 24. The pocket 24 may be positioned toward one side of the top panel 12 of the cover 10 (e.g., adjacent to the left right panel 18 or left panel 20) to allow for easier access to the pocket 24 from one side of the mattress 2.

In some embodiments, although not shown in FIG. 1, a bottom edge of the foot panel 16 may be secured to a foot edge of the bottom panel 14. In other embodiments, at least a portion of the foot edge of the bottom panel 14 may remain separate from the bottom edge of the foot panel 16.

With added reference to FIGS. 2-5, the bottom panel 14 may be split, with a first portion 28 that extends from the right panel 18 and a second portion 30 that extends from the left panel 20. The first portion 28 of the bottom panel 14 may be secured to the right panel 18 or the first portion 28 may comprise an extension of the right panel 18. The second portion 30 of the bottom panel 14 may be secured to the left panel 20 or the second portion 30 may comprise an extension of the left panel 20.

One or both of the first portion 28 and second portion 30 of the bottom panel 14 may include fasteners 26 that enable the first portion 28 and second portion 30 to be reversibly coupled to each other. Each fastener 26 may be positioned and oriented in a manner that facilitates coupling of the first portion 28 and second portion 30 of the bottom panel 14 to each other at any of a variety of different locations. For example, the fastener 26 may extend along a portion of the width of is corresponding portion 28, 30 of the bottom panel 14. The fasteners 26 may enable the first portion 28 and second portion 30 to be pulled together and reversibly coupled to each other in a variety of locations to allow for the cover 10 to be snugly secured to the foot of the mattress 2 (FIGS. 6-10) by pulling the first portion 28 and second portion 30 toward each other from opposite sides of the foot of the mattress 2. Such an arrangement may enable the cover 10 to accommodate mattresses 2 of different thicknesses.

It will be appreciated that any of a variety of different types of fasteners 26 may be used. Without limitation, the fasteners 26 may include touch fasteners (e.g., hook fasteners (e.g., in embodiments where fasteners 26 are only included on the first portion 28 or the second portion 30 of the bottom panel 14), hook and loop fasteners, hook-hook fasteners, etc.). A first portion (e.g., the hook portion, etc.) of a touch fastener 26 may be secured to the first portion 28 of the bottom panel 14, while a second portion (e.g., the loop portion, etc.) of the touch fastener 26 may be secured to the second portion 30 of the bottom panel 14. Other embodiments of fasteners 26 that may be used include, but are not limited to, snaps, buttons or similar.

In some embodiments, the cover 10 may also include a flap 36 extending along a bottom edge of the foot panel 16. The flap 36 may be secured to the bottom edge of the foot panel 16 or the flap 36 may comprise an extension of the foot panel 16. The flap 36 may extend partially over the bottom panel 14.

Figure 2:
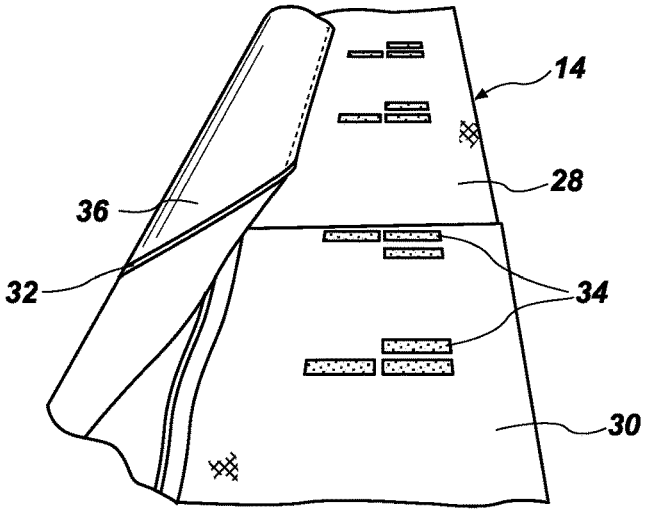
FIGS. 2 and 3 are perspective views showing a bottom of the embodiment of mattress foot cover shown in FIG. 1.
Figure 3:
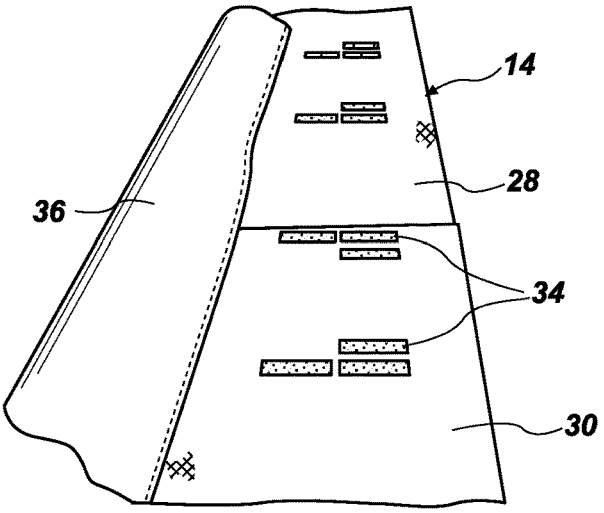
Figure 4:
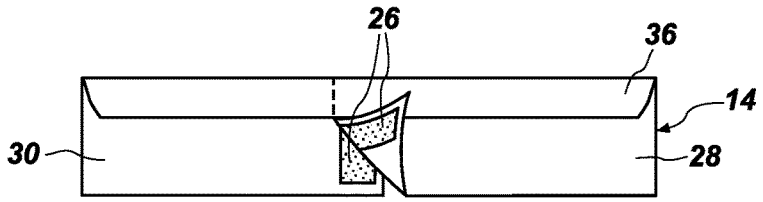
FIGS. 4 and 5 are bottom plan views of the embodiment of mattress foot cover shown in FIG. 1.
Figure 5:
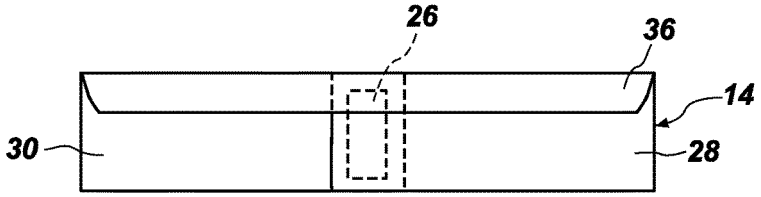

Additional fasteners 32 and 34 may be respectively associated with the flap 36 and the bottom panel 14. For example, as shown in FIGS. 2 and 3, the additional fasteners 32 may be provided on a bottom surface of the flap 36, while complementarily configured and positioned additional fasteners 34 may be positioned on the bottom panel 14. Although not limiting, FIGS. 2 and 3 illustrate an embodiment in which the additional fasteners 32 are positioned adjacent to an edge of the flap 36 and the additional fasteners 34 are elongated (e.g., substantially rectangular, etc.) and run transverse to the width of the bottom panel 14. The additional fasteners 32 and 34 may be evenly spaced along the widths of the flap 36 and bottom panel 14, respectively.

In some embodiments, the additional fasteners 32 and 34 may comprise complementary touch fasteners (e.g., hood and loop fasteners, hook-hook fasteners, etc.). Without limitation, the additional fasteners 32 on the flap 36 may include the hooks, while the additional fasteners 34 on the bottom panel 14 may comprise the loops. It will be appreciated that either of the additional fasteners 32 with their fastening portions are interchangeable. It will also be appreciated that other embodiments and arrangements of fasteners may also be used as the additional fasteners 32 and 34.

The flap 36 may assist in the ready placement and securement of the cover 10 to the foot of a mattress 2. For example, the flap 36 may effectively adjust the height of the foot panel 16 to accommodate the thickness of the mattress 2 and/or effectively adjust the length of the bottom panel 14 to ensure that the bottom panel 14 is aligned with the top panel 12 on the opposite surface of the mattress 2. By allowing for the flap 36 to effectively shorten the length of the bottom panel 14, the flap 36 may facilitate snug, secure fitting of the cover 10 to the foot of the mattress 2. The flap 36 and the additional fasteners 32 and 34 associated with the flap 36 and the bottom panel 14 may also allow for the ready removal of the cover 10 from the foot of the mattress 2 (e.g., for easy laundering, etc.).

The entire cover 10 may comprise a single type of fabric or material. Alternatively, the bottom panel 14 may be of a different material than each of the other panels 12, 16, 18, and 20 and the flap 36 because the bottom panel 14 will not likely be seen by a consumer. Adjacent features of the cover 10 (e.g., the panels 12, 14 (28, 30), 16, 18, and 20 and the flap 36, if any, may be secured together in any suitable manner (e.g., as seams, which may be sewn, welded, taped, etc.) and/or they may be continuous with each other.

When the cover 10 is assembled in the manner shown in FIGS. 6-10, the cover 10 may provide a void that receives a foot of a mattress 2. An opening 22 to the void may be positioned on a first side of the cover 10 that allows for the foot of the mattress 2 to be positioned within the opening 22. The cover 10 may be positioned toward the foot 3 of the mattress 2 to allow for individuals to test out mattresses 2 without removing shoes but also without dirtying up the mattress 2 or bed linens that may be on the mattress 2.

Figure 6:
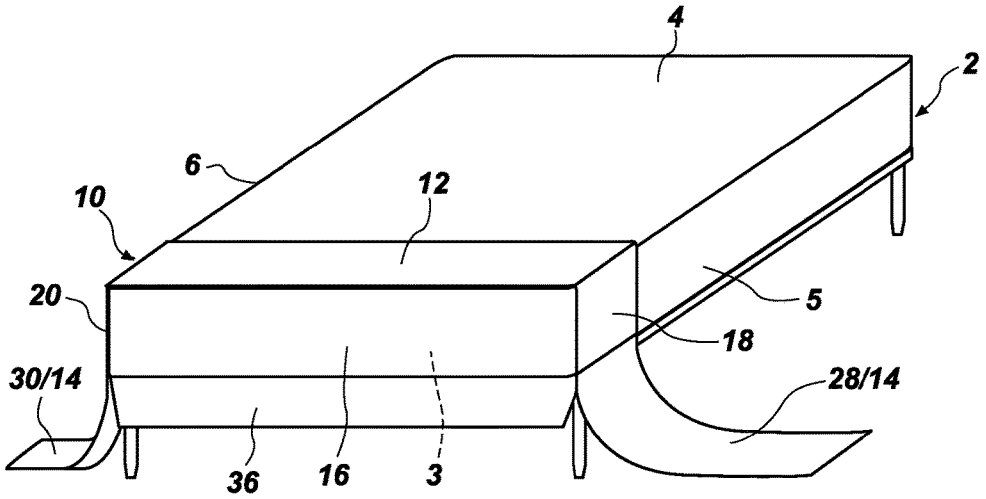
FIG. 6 is a perspective view showing placement of the embodiment of mattress foot cover shown in FIG. 1 being placed over the foot of a mattress.

With more specificity, FIG. 6 shows an embodiment of placement of an embodiment of a cover 10 on the foot 3 of a mattress 2. The top panel 12 of the cover 10 is placed on an upper surface 4 of the mattress 2, adjacent to the foot 3 of the mattress 2. The foot panel 16 of the cover 10 is positioned against the foot 3 of the mattress 2. The right panel 18 and left panel 20 of the cover 10 are respectively positioned over the right side 5 and left side 6 of the mattress 2.

Figure 7:
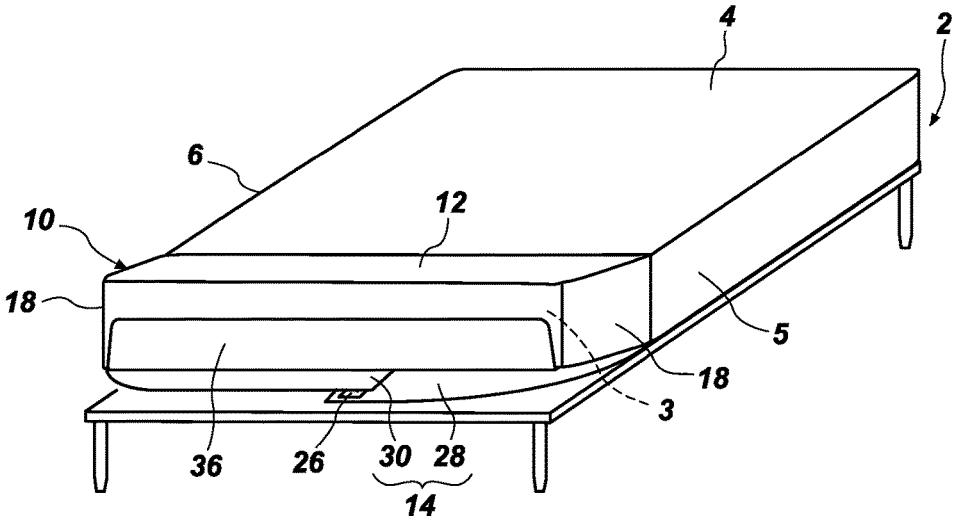
FIGS. 7-9 are perspective views illustrating assembly of the embodiment of mattress foot cover shown in FIG. 1 on the foot of the mattress.
Figure 8:
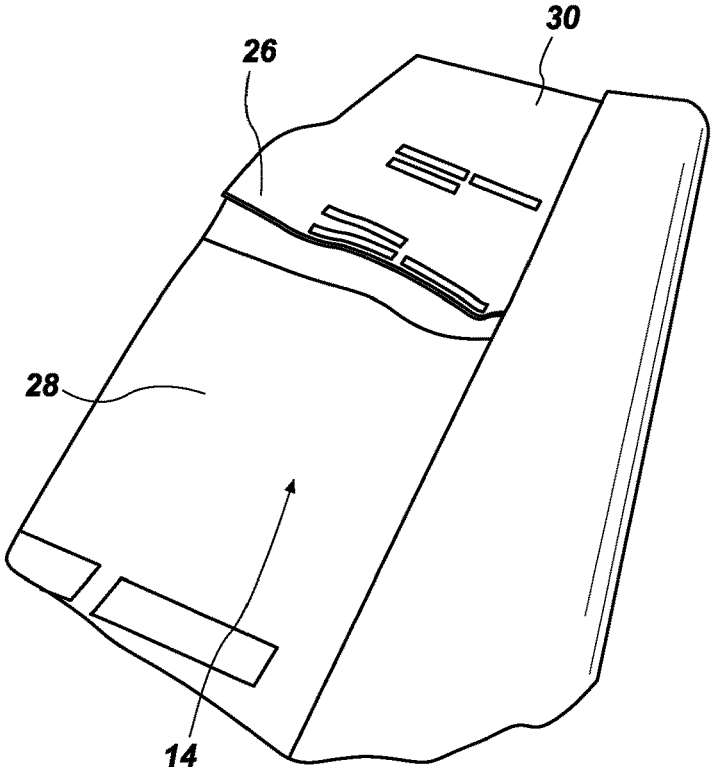
Figure 9:
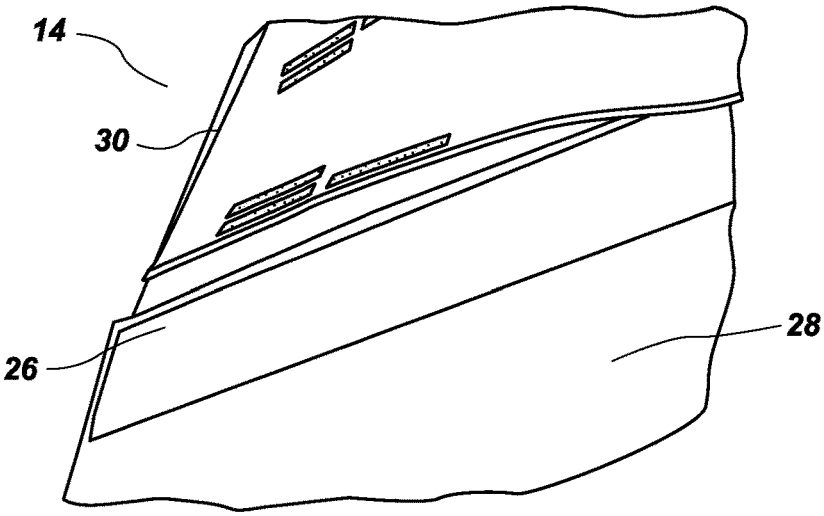

As illustrated by FIGS. 7-9, the foot 3 of the mattress 2 may be lifted and the first portion 28 and second portion 30 of the bottom panel 14 of the cover 10 may be pulled together and coupled to one another beneath a bottom surface 7 of the mattress 2. More specifically, fasteners 26 (FIGS. 2 and 3) on the first portion 28 and/or second portion 30 may couple the first portion 28 and second portion 30 to each other. In embodiments where the cover 10 includes a flap 36, the flap 36 may be lifted out of the way as the first portion 28 and second portion 30 are pulled together and coupled to each other.

The flap 36 may then be pulled downwardly over the foot 3 of the mattress 2 and secured to the bottom panel 14; for example, by engaging the additional fasteners 32 on the flap 36 and the additional fasteners 34 on the bottom panel 14.

Figure 10:
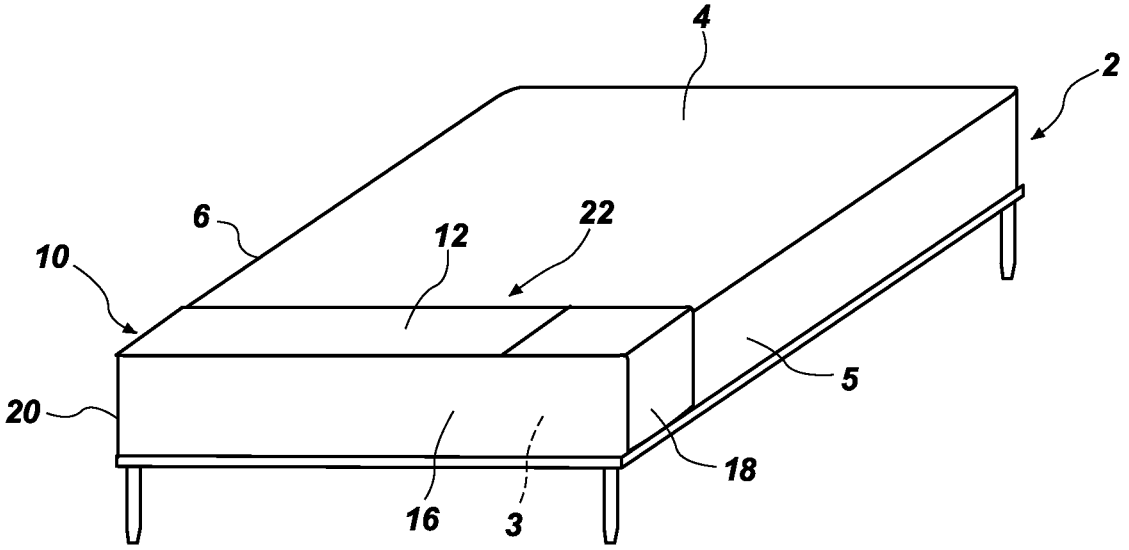
FIG. 10 is a perspective view showing the embodiment of mattress foot cover assembled with the foot of a mattress.

FIG. 10 shows the cover 10 sized and snugly secured to the foot 3 of the mattress 2.

Although the foregoing description contains many specifics, these should not be construed as limiting the scopes of the inventions recited by any of the appended claims, but merely as providing information pertinent to some specific embodiments that may fall within the scopes of the appended claims. Features from different embodiments may be employed in combination. In addition, other embodiments may also lie within the scopes of the appended claims. All additions to, deletions from and modifications of the disclosed subject matter that fall within the scopes of the claims are to be embraced by the claims.

What is claimed:

1. A cover for a foot of a mattress comprising:

a top panel extendable over the foot of the mattress without being extendable beyond an intermediate portion of the mattress;

a bottom panel including a left side and a right side that are separate from each other and that at least partially overlap each other, the bottom panel extendable beneath the foot of the mattress without being extendable beyond the intermediate portion of the mattress;

three side panels secured to three sides of a periphery of the top panel and to three sides of a periphery of the bottom panel; and an opening with dimensions that receive the foot end of the mattress.

2. The cover of claim 1, wherein the three side panels comprise:

a right panel with a top edge secured to a right peripheral edge of the top panel and a bottom edge secured to a right peripheral edge of the bottom panel;

a left panel with a top edge secured to a left peripheral edge of the top panel and a bottom edge secured to a left peripheral edge of the bottom panel; and a foot panel with a top edge secured to a foot edge of the top panel, a right edge secured to a foot edge of the right panel, and a left edge secured to a foot edge of the left panel.

3. The cover of claim 1, wherein the top panel includes a pocket biased toward one side of the top panel, at least two sides of a periphery of the pocket secured to the top panel.

4. The cover of claim 1, wherein the left side and the right side of the bottom panel can be reversibly secured to each other at any of a plurality of overlapped arrangements.

5. The cover of claim 4, further comprising:

at least one fastener that reversibly secures the left side and the right side of the bottom panel to each other in any of the plurality of overlapped arrangements.

6. The cover of claim 1, wherein a bottom edge of the foot remains unsecured from a foot edge of the bottom panel and further comprising:

a flap extending from the bottom edge of the foot, the flap being positionable over a bottom portion of a foot end of the mattress and/or beneath any of a plurality of locations of a bottom surface of the mattress adjacent to the foot end of the mattress.

7. A foot cover for a foot of a mattress comprising:

a top panel;

a bottom panel including a left side and a right side that are disconnected from each other but have a plurality of overlapped arrangements to accommodate the mattresses of different thicknesses;

side panels between opposite sides of the top panel and the bottom panel;

an end panel between foot ends of the top panel and the bottom panel; and an opening that receives the foot of the mattress, the top panel, the bottom panel, the side panels, and the end panel arranged in such a way as to make the opening and the foot cover adjustable to enable the foot cover to be used with mattresses of different thicknesses.

8. A method of covering a foot portion of a mattress with a cover, comprising:

inserting the foot portion of the mattress into an opening of the cover, the cover comprising:

a top panel;

a bottom panel;

three side panels, wherein the top panel is secured along three sides of its periphery to the three side panels, and wherein the bottom panel is secured along three sides of its periphery to the three side panels; and an opening; and adjusting a first portion and a second portion of the bottom panel that are separate from each other to fit the cover to a thickness of the foot portion of the mattress which comprises: establishing an overlapping arrangement between the first portion and the second portion of the bottom panel to adjust a width of the bottom panel.

9. The cover of claim 2, wherein:

an entirety of the top edge of the foot panel is secured to the foot edge of the top panel; and a portion of a bottom edge of the foot panel is secured to a foot edge of the bottom panel.

10. The cover of claim 5, wherein the at least one fastener is provided along an end of the left side or the right side of the bottom panel.

11. The cover of claim 5, wherein the at least one fastener comprises a touch fastener.

12. The cover of claim 6, further comprising:

a flap fastener for securing the flap in place over a bottom portion of a foot end of the mattress and/or beneath any of the plurality of locations of the bottom surface of the mattress adjacent to the foot end of the mattress.

13. The foot cover of claim 7, further comprising:

at least one fastener that secures the left side and the right side of the bottom panel in any of the plurality of overlapped arrangements.

14. The foot cover of claim 7, wherein a bottom edge of the end panel is disconnected from an end of the bottom panel.

15. The foot cover of claim 14, wherein the end panel or a flap extending from the bottom edge of the end panel has a length that enables it to be partially positioned under the foot end of any of the mattresses of different thicknesses.

16. The method of claim 8, wherein adjusting the first portion and the second portion of the bottom panel of the cover to fit the cover to the thickness of the mattress further comprises:

securing the first portion and the second portion of the bottom panel in the overlapping arrangement with at least one fastener.

17. The method of claim 8, wherein adjusting the first portion and the second portion of the bottom panel of the cover to fit the cover to the thickness of the mattress further comprises:

placing an end of an end panel of the cover or a flap extending from a bottom edge of the end panel beneath a bottom of the foot portion of the mattress.

* * * * *